US007156024B2

(12) United States Patent
Ronn et al.

(10) Patent No.: US 7,156,024 B2
(45) Date of Patent: Jan. 2, 2007

(54) DEVICE FOR WARHEAD CHARGES FOR CARGO AMMUNITION UNITS

(75) Inventors: Torsten Ronn, Karlskoga (SE); Nils Johansson, Karlskoga (SE); Thomas Widlund, Karlskoga (SE)

(73) Assignee: BAE Systems Bofors AB (SE)

( * ) Notice: Subject to any disclaimer, the term of this patent is extended or adjusted under 35 U.S.C. 154(b) by 0 days.

(21) Appl. No.: 10/312,718

(22) PCT Filed: Jun. 20, 2001

(86) PCT No.: PCT/SE01/01402

§ 371 (c)(1),
(2), (4) Date: Jul. 11, 2003

(87) PCT Pub. No.: WO02/03011

PCT Pub. Date: Jan. 10, 2002

(65) Prior Publication Data

US 2004/0089185 A1 May 13, 2004

(30) Foreign Application Priority Data

Jul. 3, 2000 (SE) ..... 0002491

(51) Int. Cl.
*F42B 12/58* (2006.01)

(52) U.S. Cl. ..... 102/489; 102/315; 102/494; 89/1.1

(58) Field of Classification Search ..... 102/489, 102/315, 494; 89/1.1
See application file for complete search history.

(56) References Cited

U.S. PATENT DOCUMENTS 2,409,282 A * 10/1946 Hopkins ..... 102/396
2,426,269 A * 8/1947 Hopkins ..... 102/315
2,866,414 A * 12/1958 Smith ..... 102/476
2,939,778 A * 6/1960 McKinley ..... 206/222
3,589,293 A * 6/1971 Major ..... 102/477
3,815,504 A * 6/1974 Tieben ..... 102/496
4,095,528 A * 6/1978 Post ..... 102/381
4,383,485 A 5/1983 Coates et al.
4,516,501 A * 5/1985 Held et al. ..... 102/496
4,699,061 A 10/1987 Jeffers
4,920,852 A * 5/1990 Miller ..... 86/1.1
5,014,623 A * 5/1991 Walker et al. ..... 102/477
H001048 H * 5/1992 Wilson et al. ..... 102/496

FOREIGN PATENT DOCUMENTS

DE 1453828 7/1970

* cited by examiner

*Primary Examiner*—Michelle Clement
(74) *Attorney, Agent, or Firm*—Connolly Bove Lodge & Hutz, LLP; Larry J. Hume

(57) ABSTRACT

A warhead charge device (18, 18', 18", 18'") arranged to carry liquid explosive (11), and which device is for use in an ammunition cargo unit such as a missile. The device incorporates at least two confined spaces (2, 6, 9) equipped with or, while the function of the device is in operation, capable of receiving liquid explosive (11) or components thereof via a device such as a pump device arranged to transfer completely or partially the explosive or components thereof from at least the first confined space to the other confined space, or vice versa.

9 Claims, 5 Drawing Sheets

DEVICE FOR WARHEAD CHARGES FOR CARGO AMMUNITION UNITS

BACKGROUND

The present invention relates to a warhead charge device for ammunition cargo units such as missiles, cruise missiles, light assault weapons, etc. The device is arranged to carry liquid explosive, herein denoting viscous explosive such as explosive mixed into slurry.

The proposal of ammunition units of the said types—which are individually dedicated to specific types of targets—is already known, and can be generally referenced in applicable patent literature. Thus ammunition units exist that are effective against hard targets, and there are other ammunition units that are effective against soft targets, etc.

There is a general desire to reduce the assortment of ammunition cargo units, and for a proposal to enable such units to combat a wider range of target types. One and the same ammunition unit shall thus be deployable in different scenarios and situations with retained effectiveness in each type of scenario and situation. The purpose of the present invention is to resolve the above problem and to propose that the ammunition unit be designed to be adaptable to achieve optimal effect in each engagement situation. The adaptability involved shall be unequivocal and shall satisfy the stringent requirements pertaining to the handling and operation of the ammunition or devices in question, especially in the field. The present invention also resolves this problem.

SUMMARY

The main characteristic feature of the initially mentioned warhead charge device is that the device in question incorporates at least two confined spaces that are equipped to receive liquid explosive or components thereof, or have the capability to do this while the device is operating. Another characteristic feature is that there is an arrangement to enable the explosive, or components thereof, to be completely or partially transferred from at least the first confined space to the second confined space, or vice versa. In this context 'arrangement' denotes a mechanical arrangement, overpressure/underpressure, etc. The pressure in question can be generated by compressed gas or pyrotechnics, etc. The expression 'arrangement' shall thus be interpreted in its widest sense.

In one design it is proposed that the first confined space be arranged centrally in the device adjacent to a first layer (or jacket) for the first effect components that can be comprised of pellets or fragments of large dimensions. A second confined space can then form a ring-shaped space located partly outside the first confined space and partly adjacent to a second layer for other effect components in the form of pellets or fragments of small dimensions for example. The first layer can thereby be located inside the said ring-shaped space. Furthermore, in another design a second ring-shaped space can be located outside the first ring-shaped space. The second effect layer can also be located between the first and second ring-shaped spaces.

The arrangement mentioned above can incorporate a pump device that, subject to a control system, pumps the explosive from the first confined space to the second confined space or vice versa. In one design the first confined space can be divided into two chambers that in a first function stage of the device each contains a mutually compatible explosive component. These two components are mixable in the two chambers in a second function stage of the device by complete or partial elimination of the dividing wall between the chambers on the occasion of the said second function stage. The explosive components in the two chambers are distributed in mixed state to the said first or second ring-shaped space in the same way as in the case described above where the components are mixed from the beginning, whereby transfer or distribution is performed by the said arrangement or pump device.

Additional spaces can also be utilised, and in one design the compatible explosive components in an initial stage can be applied in the said two additional spaces. In a subsequent stage the explosive components with the aid of the said arrangement or pump device can be transferred from the two additional spaces to, for example, the said first and second confined spaces that are arranged with one or more different effect layers with large pellets/fragments, small pellets/fragments, etc.

Additional design versions of the present invention are disclosed in the subsequent Patent Claims.

The above proposals achieve an attractive device that meets the said adaptability requirements, and that enables the ammunition cargo unit to be optimised for different types of target such as those that can be combated with large pellets/fragments, those that can be combated with small pellets/fragments, those that can be combated with blast effect, those that can be combated with carbon fibre rods and/or incendiary and combustion sustaining agents, etc. Proven parts, such as pump devices, can be used for transfer or re-distribution of explosive or explosive components from a first confined space to a second confined space. Alternatively, the mixing function can be performed with the aid of initiators, detonators, etc. The use of proven parts enhances safety during handling and servicing, and prepares the way for reliable ammunition cargo devices,

DESCRIPTION OF THE DRAWINGS

A currently proposed design for a device as claimed in the present invention is described below with reference to the appended FIGS. 1–5 in which FIG. 2 shows a longitudinal section partially illustrating an alternative design to that shown in FIG. 1, where the explosive is arranged in binary mixable explosive units, whereas FIG. 3 shows a longitudinal section of an overview of a warhead charge device applicable or incorporated in an ammunition cargo unit where a design as per FIG. 1 interacts with additional confined spaces for the explosive components, while

DETAILED DESCRIPTION

Figure 1:
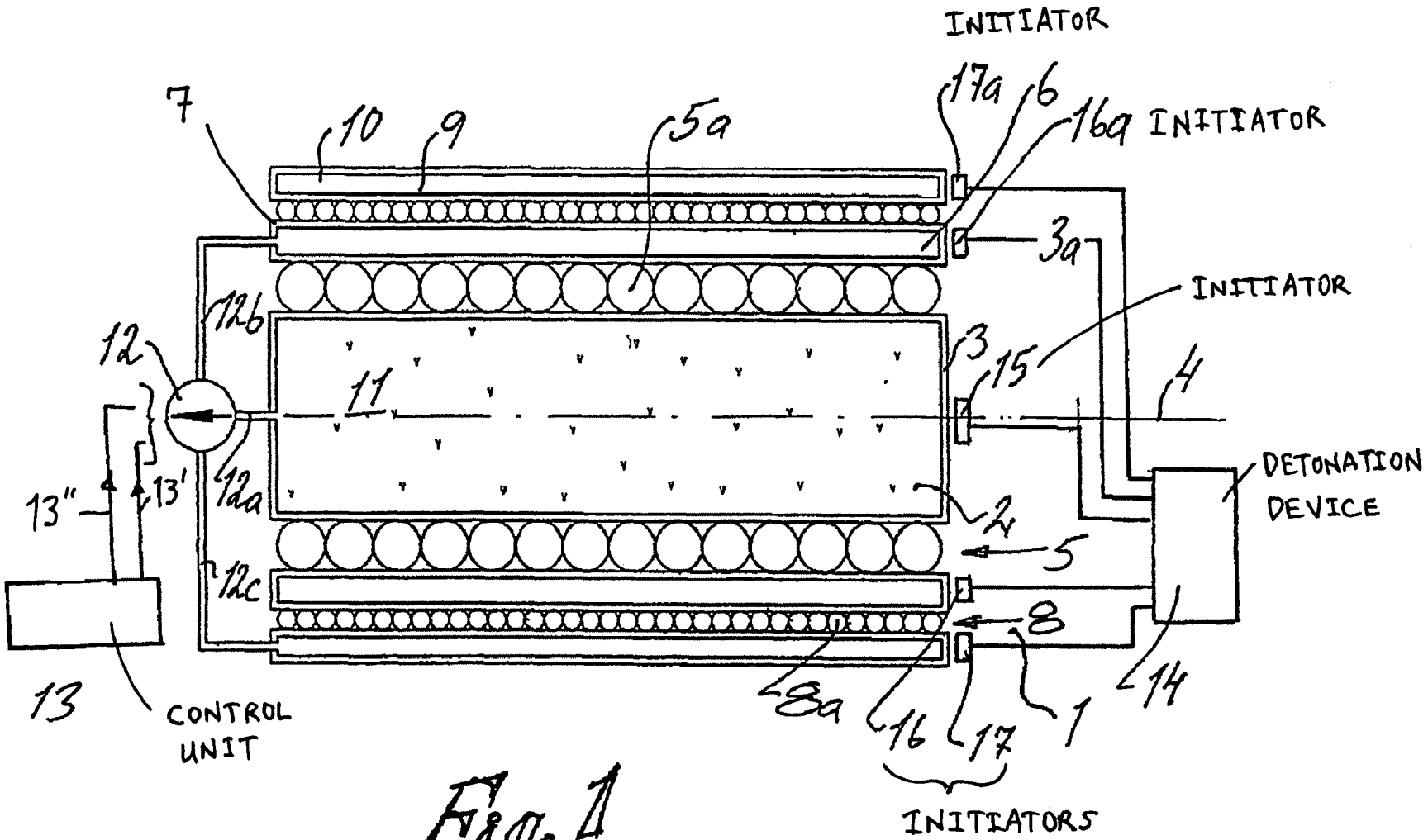
FIG. 1 shows a longitudinal section partially illustrating a warhead charge device, applicable in a missile, cruise missile, etc, with a central cylindrically shaped confined space outside of which two ring-shaped spaces are arranged, in between which layers or jackets of pellets of different dimensions are located.

FIG. 1 shows an ammunition cargo unit symbolically designated 1. The ammunition cargo unit can be of an already known type, and in this context reference is made to generally known missiles, cruise missiles, light assault weapons, etc. As the ammunition cargo unit as such is already well known it will not be described in any further detail herein. The warhead charge device comprises a first confined space 2 arranged in a cylindrical unit 3 that is elongated in the longitudinal direction of the ammunition cargo unit. Cylindrical unit 3 is located at the centre of device 1 with which it has a common longitudinal axis 4. A first effect layer 5 is arranged outside the sidewall 3*a* of unit 3. This effect layer can be comprised of pellets of large dimension whereby the expression 'large' relates to pellets that in this context are considered to have a relatively large calibre. A second confined space 6 is arranged outside effect layer 5. In FIG. 1 the pellets in effect layer 5 are designated 5*a*. This second confined space is located in a first ring-shaped unit 7, which means that the second confined space 6 is also ring-shaped or rotationally symmetrical in form. A second effect layer 8 is arranged outside the first ring-shaped unit 7. This effect layer can be comprised of pellets 8*a* of small dimension. 'Small dimension' here denotes pellet sizes that in this context are considered to have a small calibre. A second ring-shaped confined space 9 located inside a second ring-shaped unit 10 is arranged outside the second effect layer 8 or pellets 8*a*. Thus confined space 9 is also ring-shaped. A characteristic of the three confined spaces 2, 6 and 9 is that they have essentially mutually equal volumes.

As claimed in the present invention a liquid explosive 11 is initially located in confined space 2. As claimed in the present invention the liquid explosive 11 can be re-distributed to either confined space 6 or confined space 9. This re-distribution can be effected by an arrangement that can comprise an already known pump device 12 for pumping or transferring the liquid explosive. The intake pipe 12*a* of pump device 12 is thereby connected to confined space 2, and pump device 12 has two outlet pipes 12*b* and 12*c* that connect pump device 12 to confined spaces 6 and 9. The pump device 12 is controllable via an already known method from a control unit 13 that can execute control signals to pump device 12 so that it pumps from confined space 2 to confined space 6 or 9. The control signals are designated 13' and 13", and the arrangement for control of the pump can be effected using an already known method.

The arrangement described above thus enables different warhead effects to be triggered depending on the control signals from control unit 13. In a first case the explosive 11 can be triggered when it is in confined space 2. This results in a warhead function utilising pellets 5*a* and 8*a*, i.e. pellets of both dimensions. In a second case the pump 12 has pumped the explosive over to confined space 6, and a triggering of the warhead in this case results in a warhead function utilising only the small dimension pellets 8*a*. In a third case the pump 12 has pumped the explosive over to confined space 9, whereby the warhead function comprises only detonation of the explosive with ensuing damage, i.e. no pellets are released when the warhead is initiated.

Triggering is effected by means of an initiation or detonation system that can be comprised of an already known type. The triggering function of the ammunition cargo unit can thereby be determined by a device 14 via which an initiator 15 for the explosive in confined space 2, initiators 16 and 16*a* for possible explosive in confined space 6, and initiators 17 and 17*a* for possible explosive in confined space 9 can be initiated depending on which confined space 2, 6 or 9 the explosive 11 is located in when triggering occurs. The explosive can assume an initial location in confined space 2, 6 or 9 and be redistributed by a pump device 12 to another of two or more confined spaces in accordance with a predetermined strategy or programme. It is perceived that the number of confined spaces can vary from 2, 3 or more spaces. It is also perceived that the warhead charge device can be equipped with different effect layers 5, 8, for example in the form of fragments, carbon fibre rods, incendiary and combustion sustaining agents, etc. Adapting the warhead charge device to the type of target in question can be performed on the ground by a programming or other setting procedure. Alternatively, programming can be effected on board the weapon platform (e.g. aircraft) carrying the device in question. Another alternative is for programming of the device for the relevant type of target to be performed via wireless link from the ground or from the cargo unit 1 carrying the device, etc.

Figure 2:
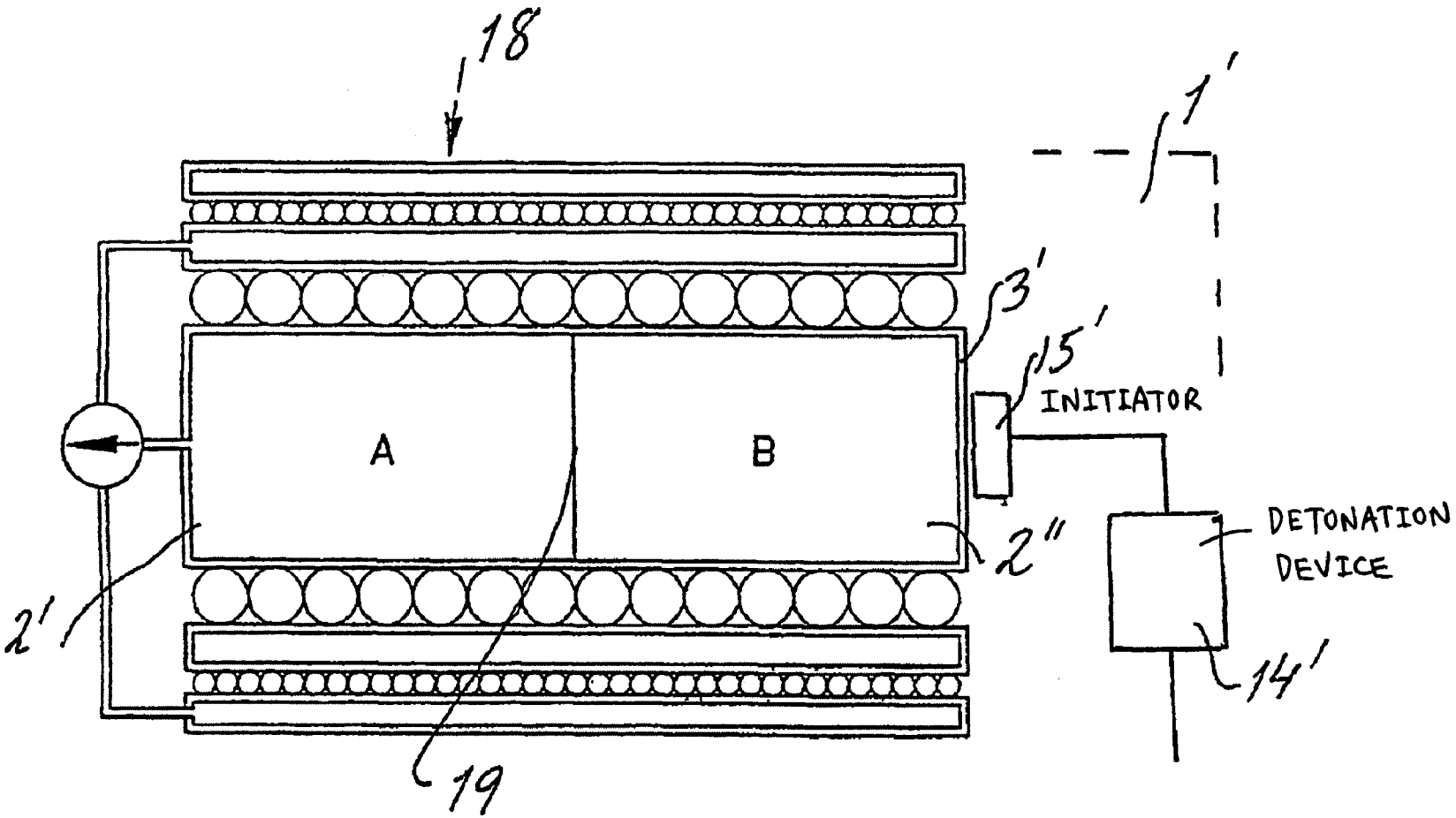

FIG. 2 shows the warhead charge device 18 with the same basic design as that illustrated in FIG. 1, but with the difference that the confined space 2, i.e. cylindrical unit 3 in FIG. 1, is subdivided into two chambers 2' and 2". The cylinder in this case is designated 3'. The explosive components are located in the two chambers from the beginning. The explosive components are compatible and can be mixed using an already known method before the warhead charge device is triggered. Components A and B can be separated by a dividing wall 19 or be pre-packed, using an already known method, in sealed packs that keep components A and B separate until a mixing function shall be performed. The dividing wall 19 can be comprised of material that self-destructs when actuated. Actuation can be effected when or before the device is used in the ammunition cargo unit 1' in question. Alternatively, some form of initiation or detonation can be effected, for example via device 14'. This device actuates initiator 15' which causes explosive components A and B to be mixed. After the said mixing, chambers 2' and 2" function as a single confined space as per FIG. 1. Alternatively, components A and B can be mixed in a third confined space and subsequently be pumped back to their original chambers in mixed form.

Figure 3:
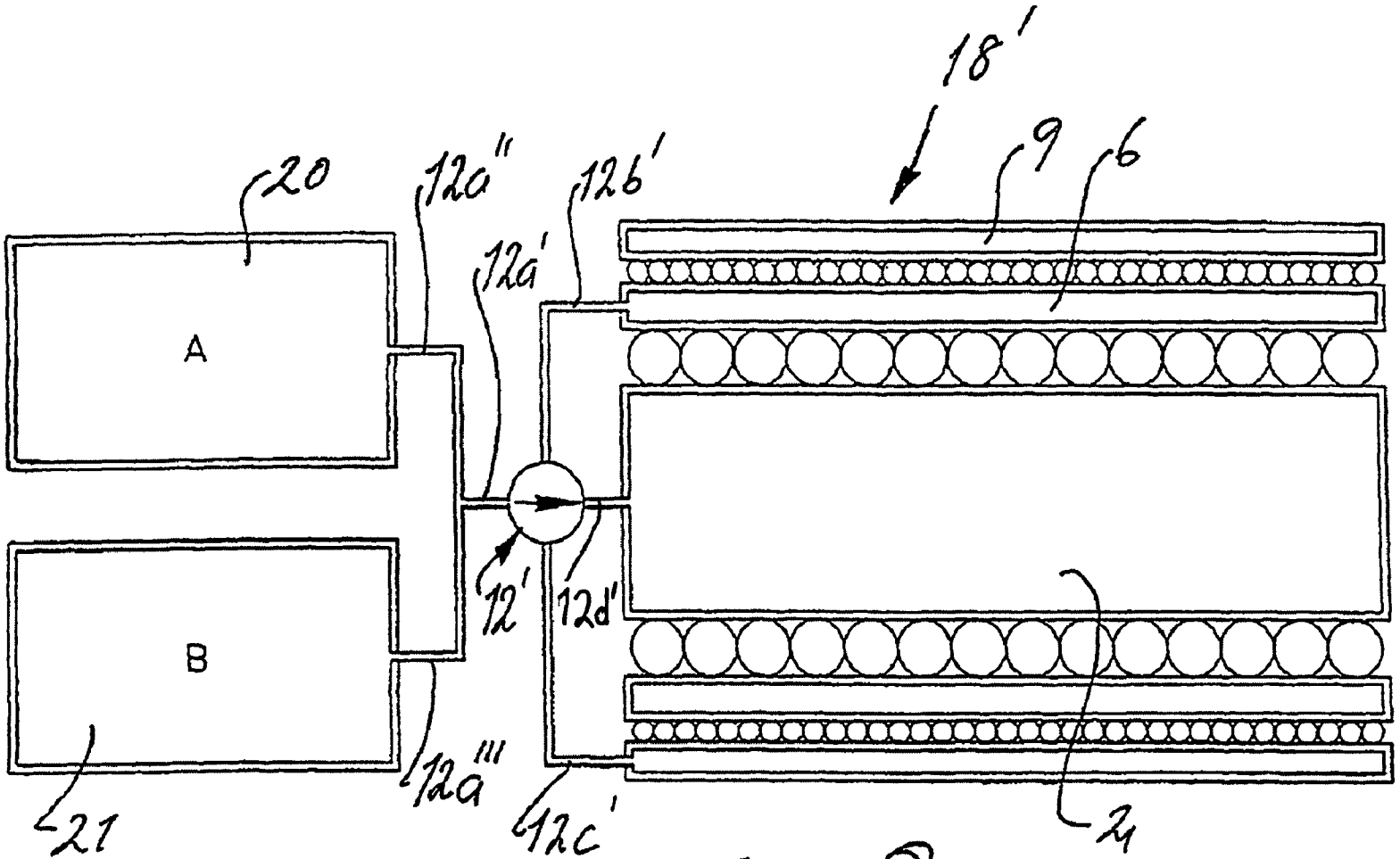

FIG. 3 shows the basic design of the warhead charge device similar to the design illustrated in FIG. 1, but with the difference that the explosive 11 (see FIG. 1) in the initial stage of the warhead charge device 18' is not located in any of the mentioned confined spaces 2, 6 and 9. Instead, the explosive or explosive components A and B are located in two additional confined spaces 20 and 21. In this design example there are two confined spaces containing explosive components A and B that are mutually compatible in accordance with the above. In this case the pump device 12' operates with three outlet pipes 12*b*', 12*c*' and 12*d*'. The pump intake pipe in this case branches into two branch pipes 12*a*" and 12*a*'". These two branch pipes connect confined spaces 20 and 21 to the pump intake 12*a*'. In the present case the mixing of explosive components A and B takes place in the actual pump function effected by pump device 12'. Thus completion of warhead charge device 18' involves actuation of pump device 12' and the transfer of the mixed explosive components A and B from confined spaces 20 and 21. Transfer is to one of the confined spaces 2, 6 or 9. It is also considered feasible to use only one additional confined space instead of two additional confined spaces 20 and 21, in which case the single additional confined space shall contain ready mixed explosive. It is also considered that the volume of confined spaces 20 plus 21 shall essentially be equivalent to each of the confined spaces 2, 6 and 9. In other respects, reference is made to the above.

Figure 4:
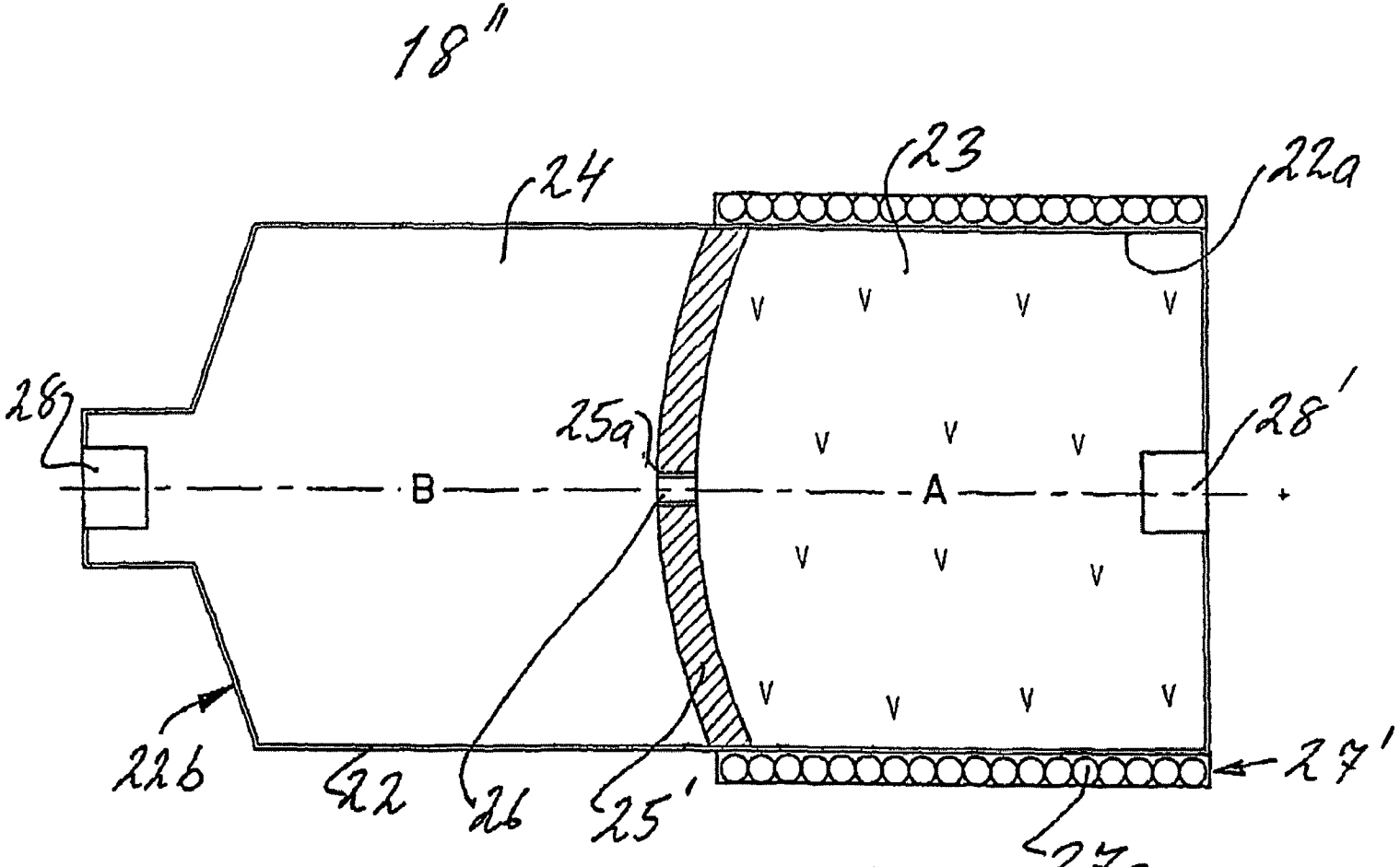
FIG. 4 shows a longitudinal section partially illustrating another design form of the warhead charge device.

FIG. 4 shows an arrangement in which the explosive can be transferred between chambers 23 and 24 depending on which warhead effect is desired. The warhead charge device 18" for an ammunition cargo unit illustrated in FIG. 4 thus comprises a cylindrical device 22 containing the two chambers 23 and 24 for the explosive. Chambers 23 and 24 are separated by a wall 25 that is arranged to be convex when viewed from chamber 24 and concave when viewed from chamber 23. The wall incorporates an opening 25*a* in which a plug 26 or equivalent is arranged. An effect layer 27, comprising pellets 27*a* in the case illustrated, is arranged outside chamber 23, i.e. outside the cylinder wall section 22*a*. Effect layer 27 can be configured in alternative ways as stated above. FIG. 4 also shows an overview outline of initiation or detonation devices 28 and 28' arranged at each end surface 22*b* of the cylinder. When actuating the device 28 in question with the explosive in chamber 24 the shape of wall 25 provides a modified shaped charge function, while initiation via 28' with the explosive in chamber 23 provides a fragmentation function utilizing pellets 27*a*. It is considered that alternative design forms can be arranged in this respect, and that the wall 25 can be designed as a piston or equivalent to enable a corresponding function to be obtained. In the FIG. other initiation or detonation devices are designated 28'.

Figure 5:
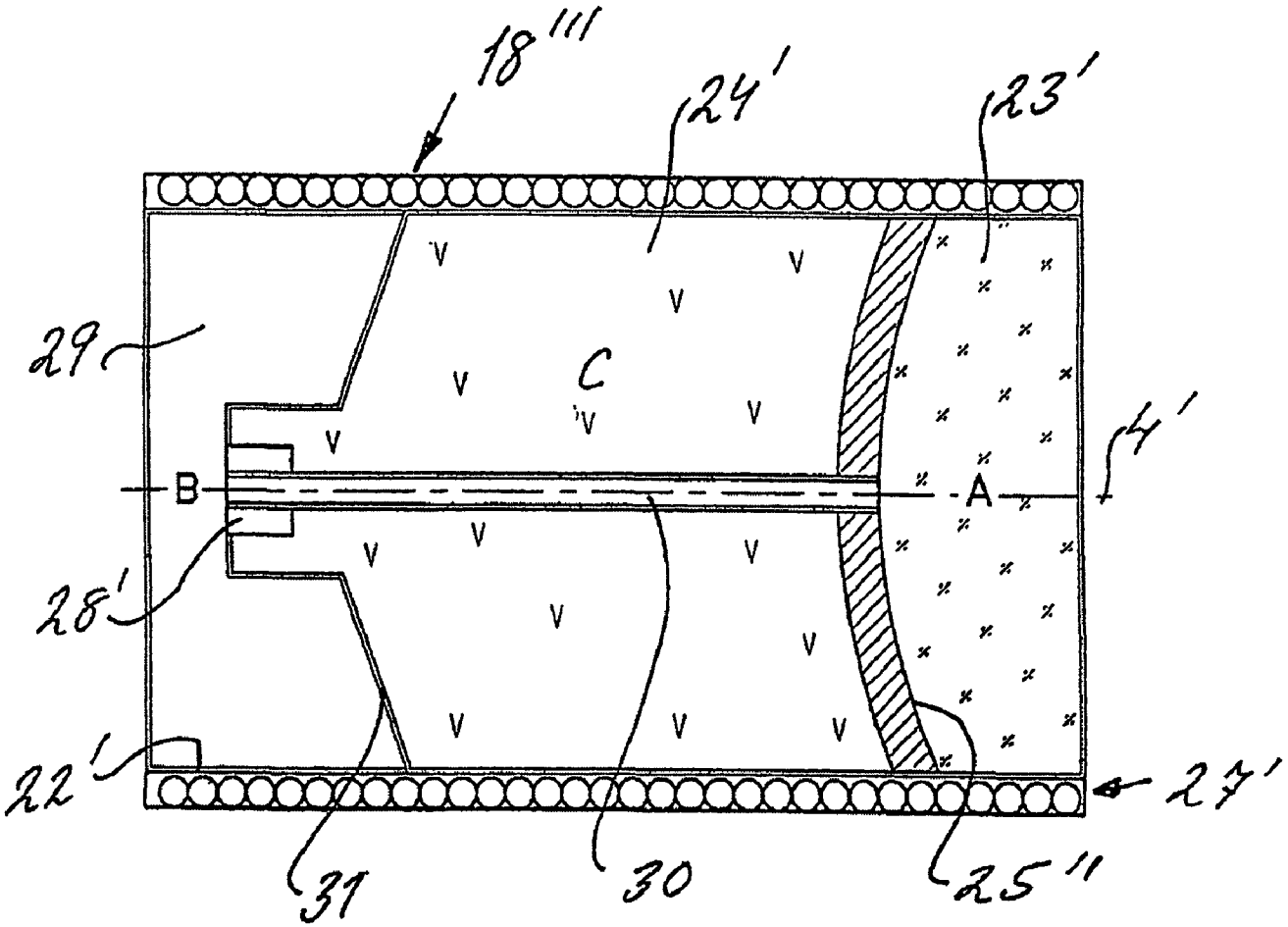
FIG. 5 shows a longitudinal section partially illustrating a warhead charge device that differs somewhat from the warhead charge device shown in FIG. 4.

In FIG. 5 the outside of cylinder 22' interacts with effect layer 27' along the entire length of cylinder 22'. Besides chambers 23' and 24', both filled with explosive, the said cylinder also incorporates an additional chamber 29. Chambers 23' and 29 are linked to each other via a duct 30. Explosive 23' can thus be transferred to chamber 29. In the design example the said duct is in the form of a pipe whose longitudinal axis coincides with that of cylinder 22' and the longitudinal axis 4' of the ammunition cargo unit. In this case chambers 23' and 24' are separated by a dividing wall 25' of similar design to wall 25 in FIG. 4. In principle cylinder 22' is separable from effect layer 27' such that in a first actuation mode the warhead charge device 18''' can be triggered with effect layer 27' lying outside cylinder 22', and in a second actuation mode the cylinder and effect layer are separated such that the mixed explosive can be triggered without the presence of any outer effect layer. Thus in FIG. 5 the binary explosive components A and B are mixable. Furthermore, there is a third component composition C in chamber 24'. In FIG. 5 there is an additional dividing wall 31 between chambers 24' and 29. In the present case chamber 24' can be termed an intermediate chamber between chambers 23' and 29.

The designs illustrated in FIGS. 4 and 5 can be given (an)other function(s) depending on the choice of explosive components and their various interactions. Thus the arrangement provides a warhead with a selectable HE or shaped charge effect. The design as illustrated in FIG. 4 can thus have the following composition and function as described below.

The warhead 18" comprises two chambers 23 and 24 of essentially equal volume separated by a shaped charge liner 25 with a central opening 25*a*. One chamber 23 has an external effect or fragmentation layer 27'. The explosive A is in liquid form and can be transferred from chamber 23 to the other chamber 24 via opening 25*a* in shaped charge liner 25, or via an external pipe system that is not illustrated. Liquid explosive with an effect almost like HMX can thereby be used. An alternative is ADN dissolved in ethanol.

If the explosive is in chamber 23 when warhead 18" is actuated the warhead will function as a fragmentation warhead in which the shaped charge liner contributes to the formation of fragments. If the explosive is in chamber 24 when the warhead is actuated it will function as a shaped charge warhead with minor fragmentation.

In an alternative design form, which is not illustrated, chamber 23 is divided into two separate reservoirs containing different (compared with the above) explosive components. The two explosive components are not explosive when in separate state. Only when they are mixed do they form an explosive substance. By varying the mixing ratio between the components the effect can be constantly varied from low to maximum within the limits at which the mixture can be detonated. The explosive can be transferred between the two reservoirs either before launch or while travelling to the target, using the methods described above. In other respects reference is made to the above concepts and ideas.

The design in FIG. 5 can also be described from another aspect compared with the above.

FIG. 5 also illustrates a warhead charge device 18''' consisting of a solid explosive charge C with shaped charge liner 25" and a through duct 30. On each side of explosive charge C there is a chamber 23' and 29. Both these chambers have essentially equal volumes, and chamber 23' contains liquid explosive A. The said liquid explosive can be transferred between chambers 23' and 29 via duct 30. If the liquid explosive is in chamber 23' when the warhead is actuated it will function as a fragmentation warhead, and the shaped charge liner will contribute to some extent to the formation of fragments. If there is liquid explosive in chamber 29 when the warhead is actuated the warhead will function as a shaped charge warhead with fragmentation effect from fragmentation layer 27'.

As described above the method for transferring the liquid explosive can consist of a mechanical arrangement such as an electrical or pneumatic arrangement. Alternatively, a pressurised or pressure difference arrangement can be used that operates with an over-and/or under-pressure arrangement, or with a pyrotechnic arrangement for pressurisation, etc.

The present invention is not limited to the design examples illustrated above, but can be subjected to modifications within the framework of the subsequent Patent Claims and the invention concept.

We hereby claim and desire to secure by Letters Patent the following:

1. A warhead device, comprising:

three confined spaces each arranged to receive at least one liquid explosive component; and a pump device operatively connected to each of the three confined spaces and arranged to selectively transfer at least a portion of the at least one liquid explosive component between at least a first confined space of the three confined spaces to one of a second confined space or a third confined space of the three confined spaces, wherein the selective transfer of the at least one liquid explosive component between the three confined spaces is controlled to achieve a desired warhead effect relative to a particular target type.

2. The device of claim 1, wherein the first confined space is centrally arranged in the warhead device adjacent to a first effect layer which includes first warhead effect components comprising pellets or fragments having a first dimension.

3. The device of claim 1, wherein the second confined space forms a first ring-shaped space located at least partly outside the first confined space and at least partly adjacent to a second effect layer which includes other warhead effect components comprising pellets or fragments having a first dimension.

4. The device of claim 3, wherein a first effect layer is located inside the first ring-shaped space.

5. The device of claim 4, wherein the third confined space comprises a second ring-shaped confined space is located outside the first ring-shaped confined space.

6. The device of claim 5, wherein the second effect layer is located between the first and second ring-shaped confined spaces.

7. The device of claim 5, wherein the pump device transfers the at least one liquid explosive component between the first confined space to one or other of the first and second ring-shaped confined spaces in response to a control signal.

8. The device of claim 1, wherein the pump device transfers the at least one liquid explosive component between the first confined space and either the second confined space or the third confined space responsive to a control signal.

9. The device of claim 1, wherein the three confined spaces are configured to receive at least two different liquid explosive components which are themselves non-explosive until mixed.

* * * * *